United States Patent [19]

Churchill

[11] Patent Number: 4,918,412

[45] Date of Patent: Apr. 17, 1990

[54] DEVICE FOR ASSISTING A COMPUTER OPERATOR IN THE USE OF COMPUTER PROGRAMS

[75] Inventor: Michael F. Churchill, Victoria, Canada

[73] Assignee: Wheel Ease Reference Corporation, Victoria, Canada

[21] Appl. No.: 259,831

[22] Filed: Oct. 19, 1988

[30] Foreign Application Priority Data

Oct. 30, 1987 [CA] Canada ..... 550642

[51] Int. Cl.[4] ..... G06C 3/00

[52] U.S. Cl. ..... 235/88 R; 235/78 R

[58] Field of Search ..... 235/78 R, 88 R

[56] References Cited

U.S. PATENT DOCUMENTS

| | | | |
|---|---|---|---|
| 896,002 | 8/1908 | Free | 235/88 R |
| 1,453,100 | 4/1923 | Fulgora | 235/88 R |
| 2,042,615 | 6/1936 | Maxson | 40/495 |
| 2,834,123 | 5/1958 | Knight | 235/61 NV |
| 3,572,584 | 3/1971 | Weaver | 235/88 R |
| 4,181,090 | 1/1980 | Calise | 235/88 R X |
| 4,323,609 | 4/1982 | Boonberg | 235/78 R X |

*Primary Examiner*—B. R. Fuller

*Attorney, Agent, or Firm*—Biebel, French & Nauman

[57] ABSTRACT

A device for assisting a computer operator in the use of computer programs includes relatively movable cards bearing data areas thereon arranged in such a way that the operator can, firstly, by visual inspection, readily locate the desired operation to be performed by the program and, secondly, by moving the cards relative to one another, obtain, for that desired operation, information regarding the command to be entered into the computer.

6 Claims, 10 Drawing Sheets

DEVICE FOR ASSISTING A COMPUTER OPERATOR IN THE USE OF COMPUTER PROGRAMS

This invention relates to a device for assisting a computer operator in the use of computer programs. In general terms, the invention provides relatively movable cards bearing data areas thereon arranged in such a way that the operator can, firstly, by visual inspection, readily locate the desired operation to be performed by the program and, secondly, by moving the cards relative to one another, obtain, for that desired operation, information regarding the command to be entered into the computer.

Various types of information finding, calculation, and display devices have been known for many years. Many of these employ a pair of disc-like bodies secured to each other for relative rotation about a central axis. At least one of the cards bears an array of information thereon while the other disc is typically provided with an indicator and one or more window areas through which the desired information is displayed after the two bodies have been indexed relative to one another in accordance with the information sought. Information finding and display devices of this nature are illustrated in the following U.S. Pat. Nos.:

| | | | |
|---|---|---|---|
| 896,002 | August 11, 1908 | Free | Scale |
| 1,453,100 | April 24, 1923 | Fulgora | Calculating Device |
| 2,042,615 | June 2, 1936 | Maxson | Indicator |
| 2,834,123 | May 13, 1958 | Knight | Interpreting Converter |
| 3,572,584 | March 30, 1971 | Weaver et al | Weight Reduction Calculator |
| 4,181,090 | January 1, 1980 | Calise | Dial-a-metric |

Although the devices described in the above patents are alleged to provide information covering a wide variety of areas, e.g. metric conversion, weight reduction and calorific allowance, geographic codes, price calculations etc., none of these devices disclose a system for assisting computer operators in the use of various computer programs. As a result, computer operators have, up to now, had to rely on bulky instruction manuals for directions. The use of these manuals gives rise to much wastage of valuable time and to perator fatigue especially in the cases where poorly organized manuals are provided. Some computer programs provide for so-called "help screens" for operator information and assistance but these have the disadvantage that they temporarily remove the screen reference from the operator.

A basic objective of the invention is to provide a simple and convenient device whereby a computer operator can readily locate a desired operation to be performed with the computer program and, by a simple manipulation of the device quickly obtain information regarding, the command to be entered into the computer so as to effect the desired operation.

Accordingly, in one aspect there is provided, a facilitating device for users of a computer program, which device comprises: (a) a first card; (b) a first data area on said first card including data on operations performable with said computer program; (c) a second data area on said first card including data on commands to be entered into a computer to carry out the operations performable with said computer program; (d)said first and second data areas being arranged so that each command in the second data area lies at essentially the same fixed angle on said card from the data in the first data area which refers to the operation performable using that command; (e) a second card normally overlying second data area, said second card having an indicator thereon, said second card normally being in close juxtaposition to said first card and movable relative thereto in a manner compatible with the fixed relationship between each command and the associated operation recited in (d); (f) window means in said second card positioned to selectively reveal a computer command corresponding to a particular operation, when the first and second cards have been moved relative to each other such that said indicator is directed at a portion of the first data area which refers to said operation.

In a further aspect of the invention the first card is a disc, said first data area is an annular band on a frontal face of said disc radially remote from the center thereof, and the second data area lies between said annular band and the center, and said second card is a disc concentric with the first disc but of smaller radius such that the first data area is exposed to view, and said discs being relatively rotatable about the centers thereof.

As a further feature of the invention, said annular band data area is divided into sectorial areas with the sectorial areas each containing the data in the form of printed descriptions of said operations.

In a preferred form of the invention, said sectorial areas which contain printed descriptions of generally related operations performable with said program are grouped together in circumferentially extending regions of said first data area under printed major headings indicating the respective groupings.

As a further desirable feature of the invention, the sectorial areas corresponding to the respective groupings are color coded to facilitate operator location of the desired operations.

As a still further desirable feature of the invention, the second disc noted above has a second window means therein and said second data area includes further data on commands associated with selected ones of said operations. This further data on commands and said second window means are located and arranged relative to each other such that when said indicator is directed at that portion of the first data area corresponding to a selected one of said operations, the corresponding further command is displayed through the second window means.

In the preferred embodiments of the invention to be described hereafter, the device includes a third disc secured to a rear face of said first disc such that the first disc is sandwiched between the second and third discs. The rear face of the first disc has further data areas thereon similar to said first and second data areas but having thereon data on operations and data on commands which differs from that in the first and second data areas. The third disc also has a window means therein and an indicator thereon both of which being located relative to the data on operations and the data on commands on said further data areas that when the indicator on the third disc is directed at a portion of the data area referring to a particular operation, the computer command corresponding to that operation is displayed through the window means of the third disc. The data is advantageously grouped and color coded as described above to facilitate operator access and usage.

For purposes of convenience, reference is made in this specification to a "command" as being displayed through the windows. This term should be read, when the context requires, to include "data on commands" so as to include not only commands per se, but also brief instructions regarding the command to be entered.

In drawings illustrating preferred embodiments of the invention:

Referring now to FIGS. 1–6 a facilitating device 10 for an operator is shown, such device being designed for use with the "WORD STAR" (trademark) word processing program. The device includes three superimposed cards in the form of discs, i.e. a first or base disc 12, a frontal disc 14, and a rear disc 16, all of the discs being secured together in close juxtaposition and relatively rotatable about a central axis defined by central grommets in the three discs through which a suitable rivet or pin passes.

Figure 3:
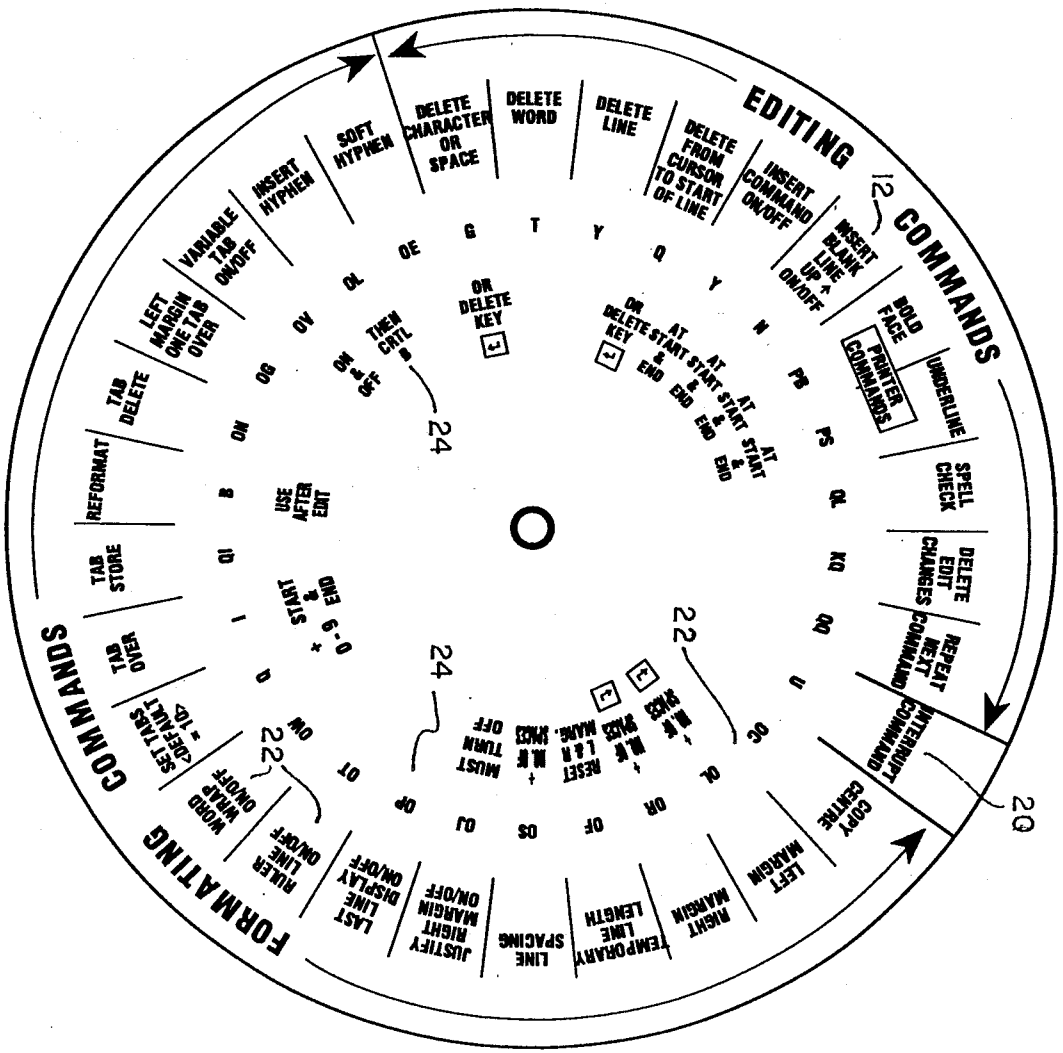
FIGS. 3 and 4 are frontal and rear views respectively of the base disc, illustrating the several data areas.
Figure 4:
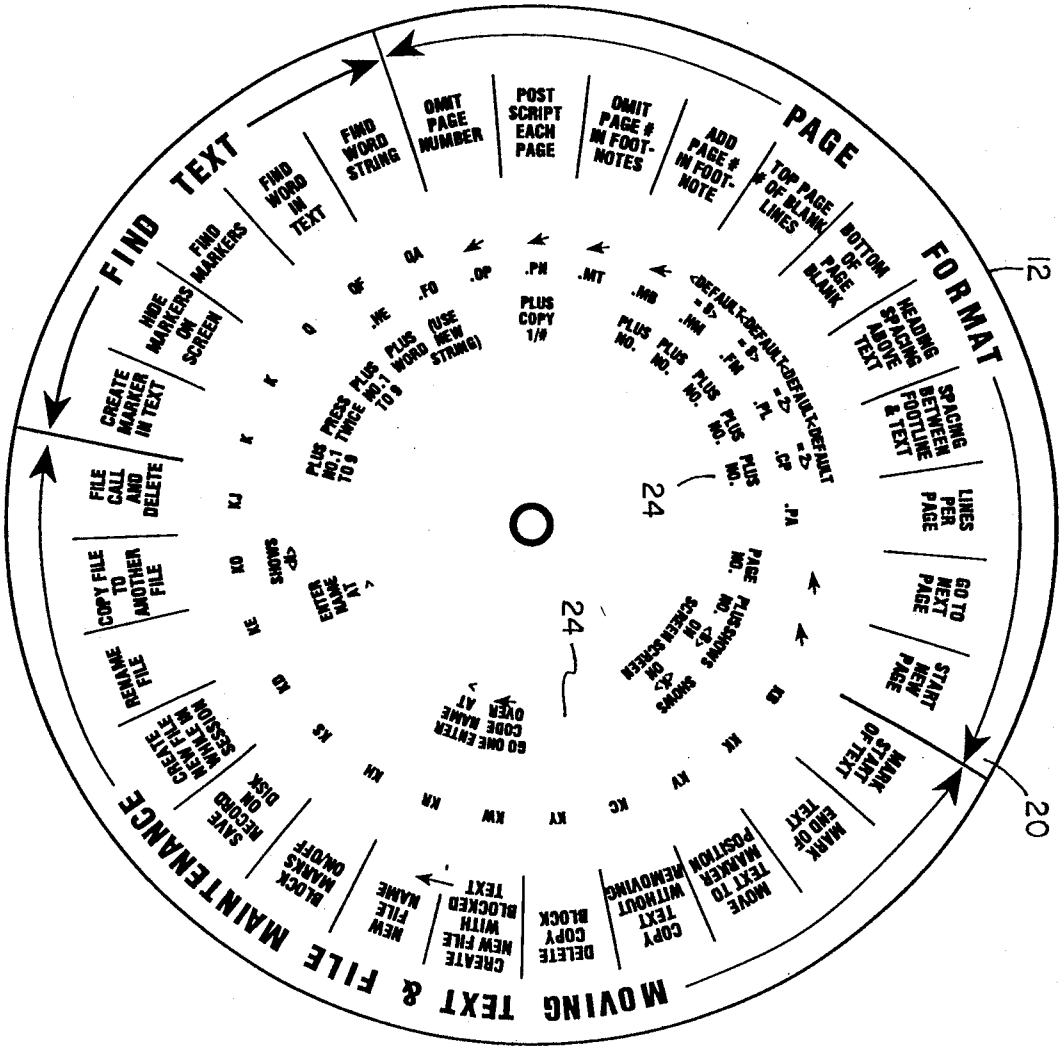
Figure 5:
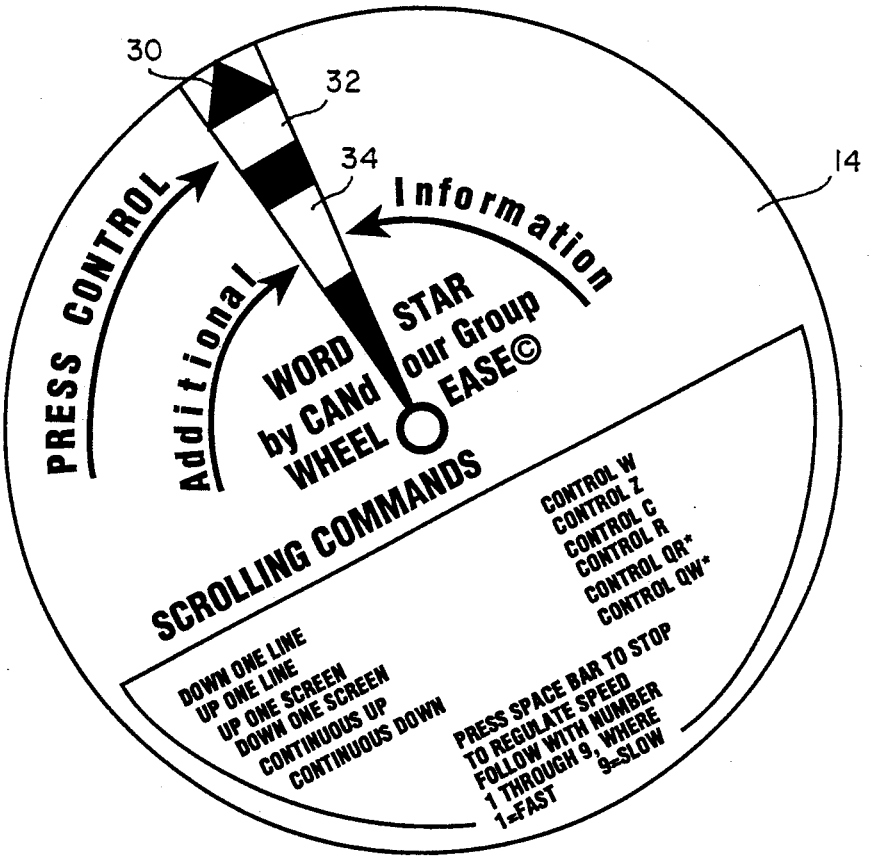
FIGS. 5 and 6 are face views of the frontal and rear discs, respectively, and between which the base disc of FIGS. 3 and 4 is sandwiched.
Figure 6:
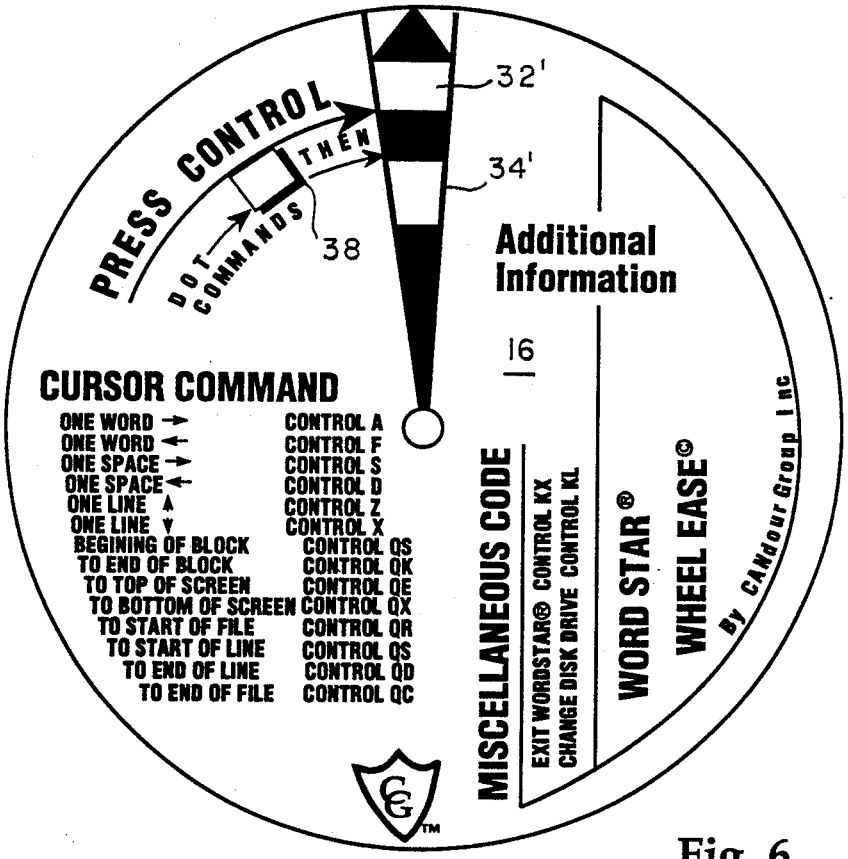
Figure 7:
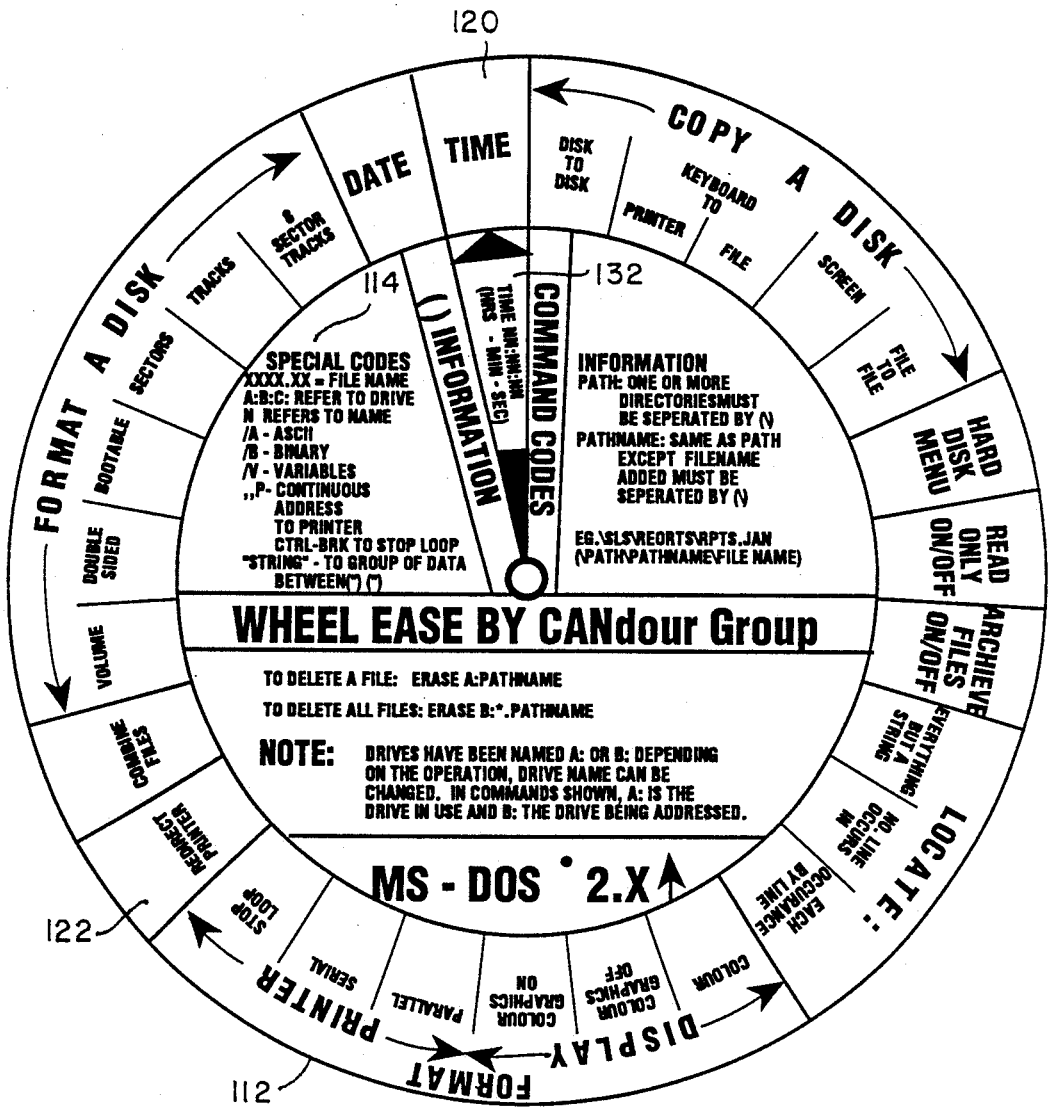
FIGS. 7 and 8 are frontal and rear views of a second embodiment of the device according to the invention.
Figure 8:
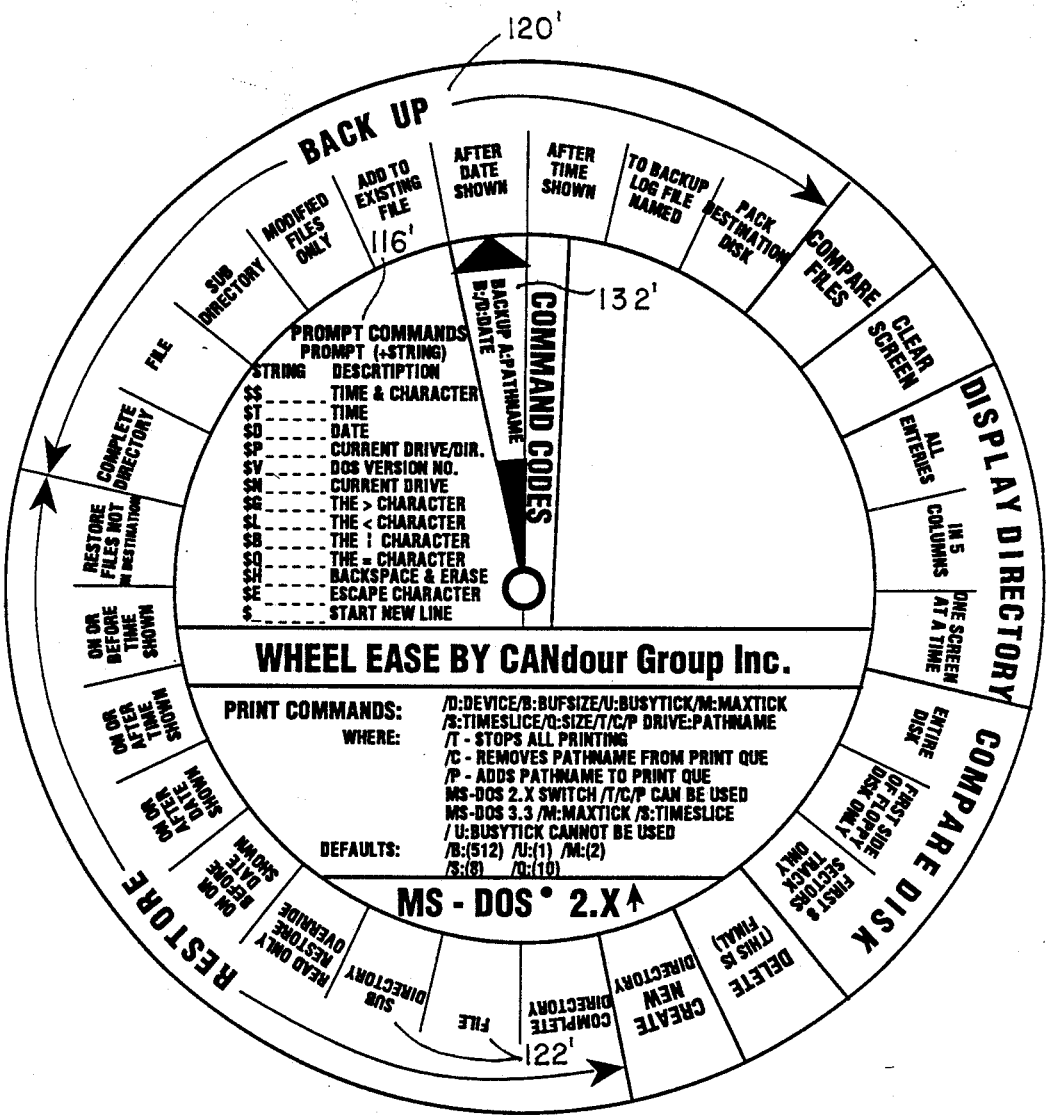
Figure 9:
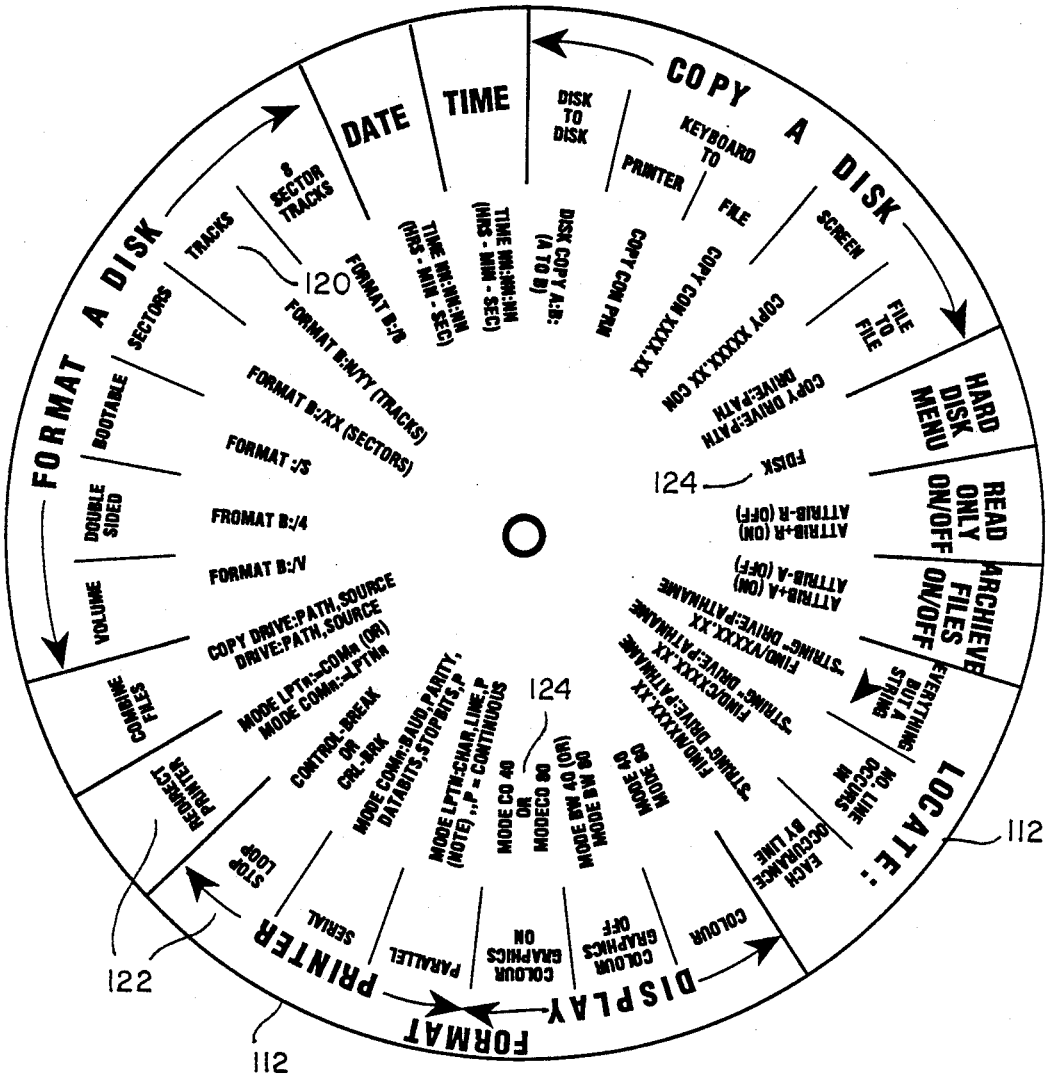
FIGS. 9 and 10 are front and rear views of the base disc of the second embodiment and showing the several data areas.
Figure 10:
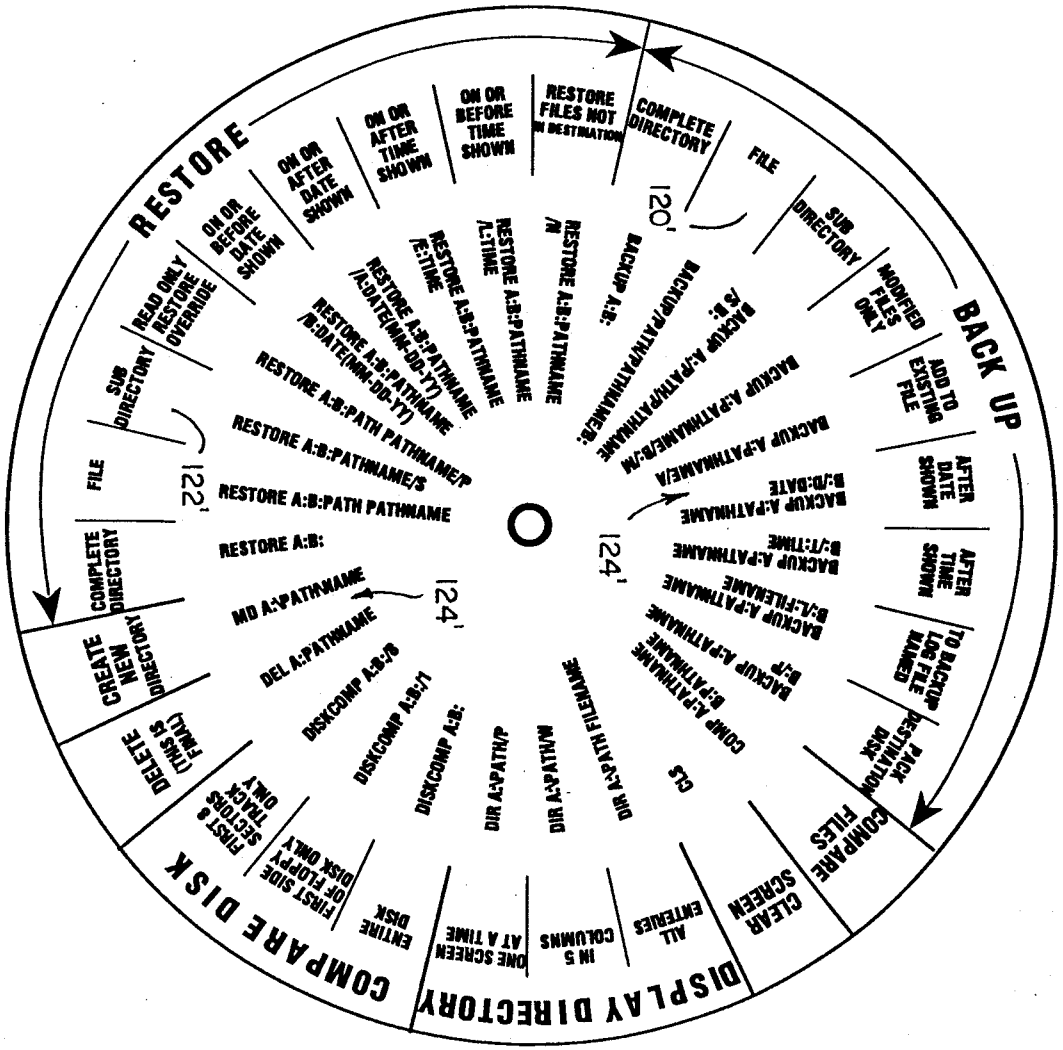

With reference to FIG. 3, the base disc 12 includes a first data area 20 extending as an annular band adjacent the perimeter of the disc. This data area includes data on operations performable with the computer program such as "editing", "formating" and the like as shown. Data area 20 is broken up into sectoria 22 with the sectorial areas each containing the data in the form of printed descriptions, e.g. "copy center" the like. Generally related operations are grouped together under major headings such as "Formating Commands" and these related groupings have a color code, e.g. green to facilitate operator identification and access. "Editing Commands" can be in a contrasting color, e.g. blue. These user operations are, as can be seen, in "plain English" (or such other language as desired) to cover the situations the operator or programmer is currently confronting. Certain operations, such as non-reversible delete operations, may be color coded in red to alert the operator and so on.

With continued reference to FIG. 3, a second data area 24 lies between the annular first data area 20 and the center of the disc. This data area contains data on commands that are to be entered into the computer to carry out the operations described in the first data area 20. For reasons which will be readily apparent, the first and second data areas are arranged so that each printed command in the second data area 24 lies at the same fixed angle on card 12 from the sector containing the printed operation which is performable using that command.

Figure 1:
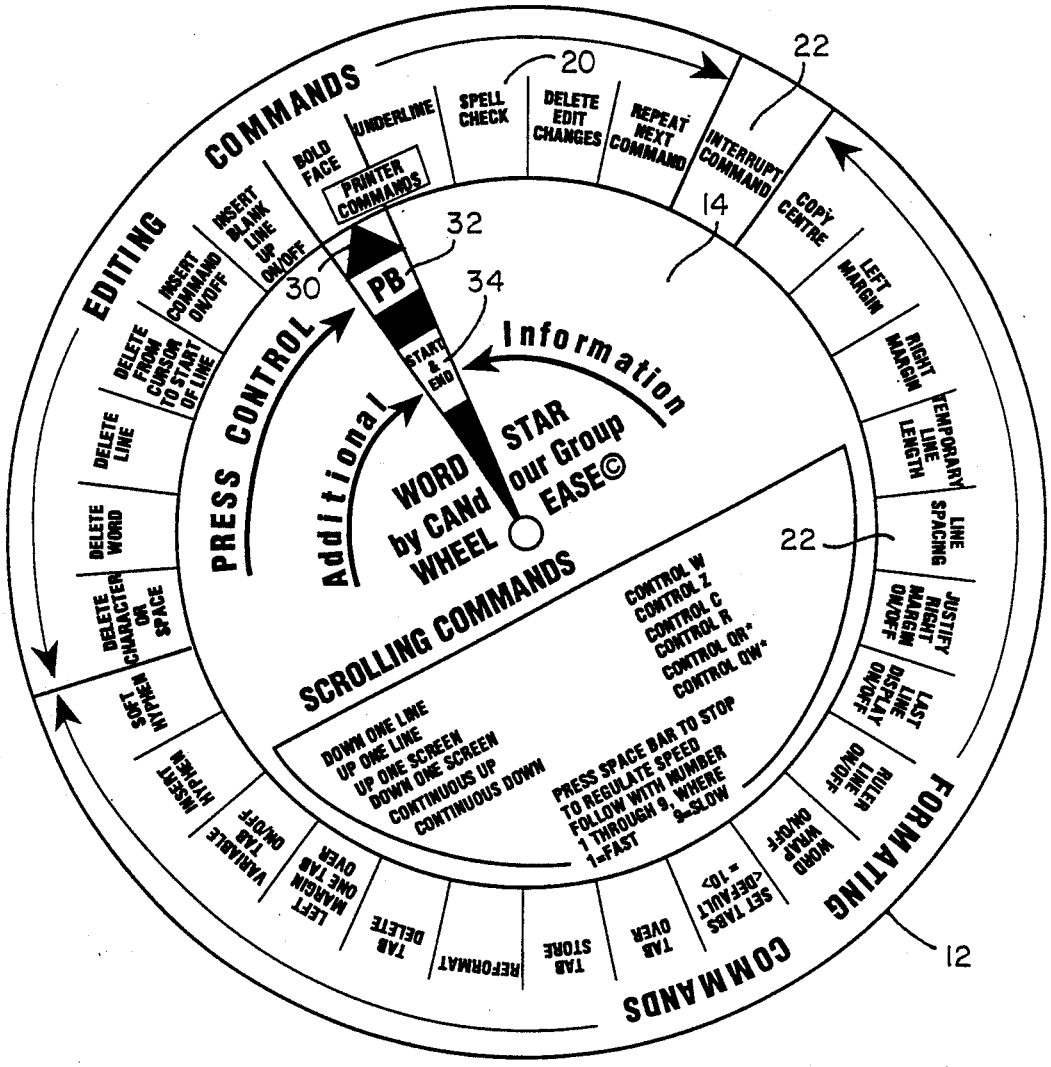
FIGS. 1 and 2 are front and rear views respectively of a first embodiment of a facilitating device according to the invention.
Figure 2:
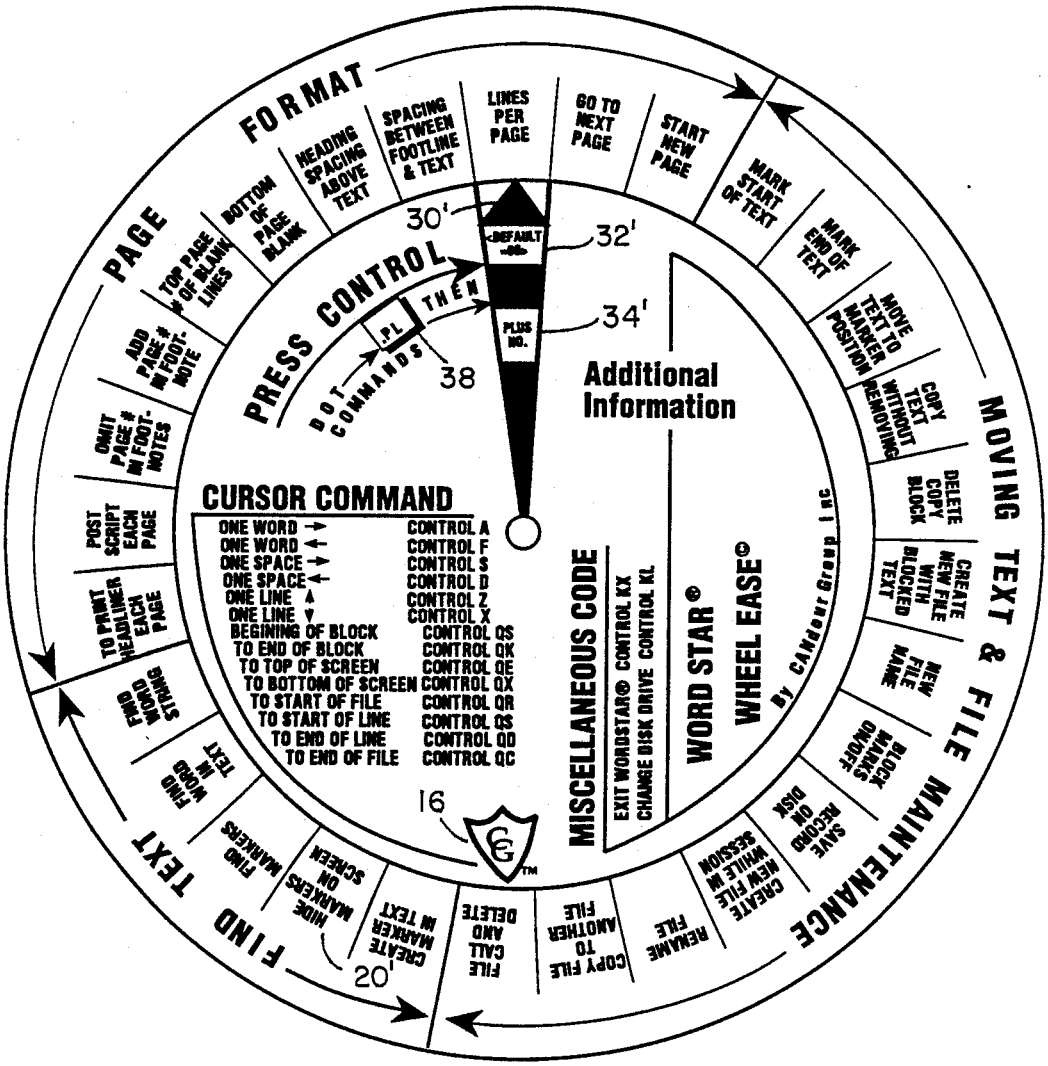

The frontal disc 14, as seen in FIG. 1, completely overlies the second data area 24 of disc 12 but the first (annular band) data area 20 is fully exposed to view. The frontal disc includes a printed indicator 30 bounded by a pair of radial lines whereby the disc 14 may be accurately "dialed" to a desired angular position so that the indicator 30 registers with the selected operation shown in data area 20. Die cut windows 32 and 34 are arranged and positioned in conformity with the fixed relation between the printed commands and printed instructions in the two data areas 20, 24 recited above to reveal only the command corresponding to the selected operation. As shown in FIG. 1, the indicator 30 is pointing to a printer command operation, i.e. "bold face" and the window 32 displays the required computer command "PB" while the window 34 displays the additional information "start and end". The face of the disc 14 also includes other useful information such as the "scrolling commands" as shown.

The rear face of the device is constructed in similar fashion. As before, the rear face of disc 12 includes the two data areas 20' and 24' containing different data on operations and data on commands. As before, the rear disc 16 overlies the central data area 24'. Rear disc 16 includes an indicator 30' and spaced windows 32', 34' as described in connection with disc 14 and the manner of usage is the same as before. Disc 16 also contains a further window 38. Window 38 is arranged in relation to the indicator 30' and a further set of data on commands in the data areas 24' such that when the disc 16 is rotated to bring the indicator 30' into registry with certain of the operations in data area 20', a further command code associated with that particular operation is displayed through the window 38. In the embodiment shown, window 38 displays "dot commands".

The rear face of the device, particularly the data area 20' thereof has the operation groupings and color codes for ease of operator identification and access as before. In both cases, the central data areas 24, 24' contrast in color with the overlying discs 14, 16 so that the data on commands is displayed clearly through the window areas.

The second embodiment illustrated in FIGS. 7–10 is adapted for use with the MS-DOS 2X program. Corresponding components have been identified with the same reference numbers increased by 100, i.e. reference 12 becomes 112 and so on. One structural difference noted is that the front and rear discs 114, 116 each have only one generally triangular window opening 132, 132' through which the data on commands is displayed. The other desirable features of the first embodiment such as the grouping of related operations and contrasting color codes are all incorporated in the second embodiment so a detailed description is believed to be unnecessary.

In both embodiments, the several discs may be made of heavy paper or Bristolboard or of plastics. The discs may be sized to fit into a standard software disc envelope or storage tray. The device is thus physically easy to store, handle and use. By virtue of the interaction between the physical structure described and the data carried by the major data areas, the operator need not refer to the operators manual at all for most common operations thus making for greater productivity, and less operator fatigue. The device may also be of great assistance in the training of new operators as the relevant information is always at hand and tedious repetitive use of bulky manuals is greatly reduced.

Preferred embodiments of the invention have been described for purposes of illustration. Numerous modifications in the detail of construction, arrangement of parts and data presented may be made while still remaining within the spirit & scope of the invention. For definitions of the invention references is to be had to the appended claims.

I claim:

1. A facilitating device for users of a computer program, which device comprises:

(a) a first card;

(b) a first data area on said first card including data on operations performable with said computer program, said first data area being an annular band on a frontal face of said first card radially spaced from the center of said first card;

(c) a second data area on said first card including data on commands to be entered into a computer to carry out the operations performable with said computer program, said second data area lying between said annular band and the center of said first card;

(d) said first and second data areas being arranged so that each command in the second data area lies at essentially the same fixed angle on said card from the data in the first data area which refers to the operation performable using that command;

(e) a second card in the form of a disc concentric with the center of said first card overlying said second data area and rotatable about the center, said second card having an indicator thereon, said second card being of smaller radius than said annular band so that said first data area is exposed to view;

(f) window means in said second card for selectively revealing a computer command corresponding to a particular operation when the first and second cards have been rotated relative to each other such that said indicator is directed at that portion of the first data area which refers to that particular operation.

2. A device as in claim 1 wherein said first annular band data area is divided into sectorial areas with the sectorial areas each containing the data in the form of printed descriptions of said operations.

3. A device as in claim 2 wherein said sectorial areas which contain printed descriptions of generally related operations performable with said program are grouped together in circumferentially extending regions of said first data area under printed major headings indicating the respective groupings.

4. A device as in claim 3 wherein the sectorial areas corresponding to the respective groupings are color coded to facilitate operator location of the desired operations.

5. A device as in claim 1 wherein the second card has a second window means therein, and said second data area includes further data on commands associated with selected ones of said operations, such further data on commands and said second window means being located and arranged relative to each other such that when said indicator is directed at that portion of the first data area corresponding to a selected one of said operations, the corresponding further command is displayed through the second window means.

6. A device as in claim 1 further including a third card in the form of a disc secured to a rear face of said first card such that the first card is sandwiched between the second and third cards, said rear face of the first card having further data areas thereon similar to said first and second data areas but having thereon data on operations and data on commands which differs from that in the first and second data areas, said third card also having a window means therein and an indicator thereon both of which being located relative to the data on operations and the data on commands on said further data areas that when the indicator on the third card is directed at a portion of the data area referring to a particular operation, the computer command corresponding to that operation is displayed through the window means of the third card.

* * * * *